United States Patent [19]

Rice

[11] 3,934,676

[45] Jan. 27, 1976

[54] SCAFFOLD STRUCTURE

[76] Inventor: Robert C. Rice, 6137 Lincoln Highway East, Fort Wayne, Ind. 46803

[22] Filed: Sept. 23, 1974

[21] Appl. No.: 508,525

[52] U.S. Cl. ..... 182/182; 182/183; 182/227

[51] Int. Cl.[2] ..... E04G 1/32; F16M 11/00

[58] Field of Search..... 182/182, 227, 183

[56] References Cited

UNITED STATES PATENTS

| | | | |
|---|---|---|---|
| 926,320 | 6/1909 | Croner | 182/182 |
| 984,846 | 2/1911 | Pichler | 182/182 |
| 1,107,881 | 8/1914 | Berntsen | 85/5 CP |
| 1,109,505 | 9/1914 | Bonenberger | 182/227 |
| 1,853,566 | 4/1932 | Lingo | 182/227 |
| 2,410,330 | 10/1946 | Ashenfelter | 182/182 |

FOREIGN PATENTS OR APPLICATIONS

| | | | |
|---|---|---|---|
| 1,112,968 | 5/1968 | United Kingdom | 182/182 |

*Primary Examiner*—Reinaldo P. Machado

[57] ABSTRACT

A scaffold structure comprising a pair of leg frames and a support frame. The support frame includes a pair of posts vertically slidably received in the leg frames and means for locking the same thereto at selected elevations. The support frame includes telescopically engaged members whereby it can be extended or contracted and locked to provide a support of different lengths.

10 Claims, 4 Drawing Figures

SCAFFOLD STRUCTURE

BACKGROUND OF THE INVENTION

1. Field of the Invention

The present invention relates to scaffold structures and in particular to a self supporting and vertically and longitudinally adjustable scaffold structure for supporting a work platform or a work piece.

2. Description of the Prior Art

Scaffold structures used during construction to support platforms or work pieces are well known. Such scaffolds are embodied in various structures ranging from the prefabricated steel structures that can be assembled into complex scaffold assemblies for erecting large buildings and the like to the simple and widely used sawhorse. Other such scaffold structures take the form of specially fabricated brackets adapted to be suspended from conventional extension ladders. The large commercial scaffold assemblies are too bulky and expensive for general use. The scaffold brackets for use with extension ladders require that the ladders be placed against a wall, typically the wall that is being worked upon. The conventional sawhorse cannot be adjusted for length or the height of the support above the floor, are bulky items to store and transport, and are, because they are typically fabricated of wood, subject to deterioration over extended periods of use. There exists, therefore, a need for a scaffold structure of reasonable size and cost. There exists a need for such a scaffold structure that can be adjusted both for the height of the support above a floor and for the length of the supporting member. There further exists a need to provide such a scaffold structure that can be disassembled and folded for compact storage.

SUMMARY OF THE INVENTION

Broadly, the present invention is a scaffold structure that provides a support for a work platform, work piece, or the like wherein the support can be adjusted both as to its height and the length of the supporting member thereof. The scaffold structure can be disassembled and compactly stored.

The scaffold structure specifically comprises at least two rigid leg frames, each of the leg frames including a pair of spaced-apart legs and a top portion. A brace is fixedly secured between the legs in spaced-apart relationship to the top portion. Upper and lower collar elements, each having an opening therethrough, are secured to the top portion and the brace, respectively, with the openings thereof disposed in vertical registry. A platform or support frame including a pair of parallel spaced-apart post members is provided, the posts having cross-sections complementary to the collar openings whereby the posts are slidably vertically received through the upper and lower collars. A platform support is provided and includes a pair of telescopically engaged platform or support members fixedly secured adjacent their distal ends to respective ones of the upper ends of the post members. Post locking means are provided for locking the posts in selected vertically displaced positions in the collar members with the platform member extending laterally between the leg frames with the platform support disposed either above or below the aforementioned top portion of the leg frames. Means are provided for locking the support members in selected telescopically extended positions to thereby provide a support of selected length.

In one specific embodiment of the invention, the legs and top portion of the leg frames are made of a single piece of rigid tubular metal formed into an arch.

In another specific embodiment of the invention, the collar elements are fabricated of tubular material having a square cross-section, the posts of the platform or support frame also being fabricated of tubular material of square cross-section whereby, when assembled, the leg frames and platform frame are restrained from relative rotation.

In yet another specific embodiment, the leg frames and platform can be disassembled, the leg frames stacked, and the platform frame secured thereto in a relatively flat configuration for compact storage.

It is therefore an object of the invention to provide an improved scaffold structure.

It is another object of the invention to provide a scaffold structure that enables adjustment of both the height and the length of the support platform.

Still another object of the invention is to provide a scaffold structure fabricated entirely of lightweight metal members.

Yet another object of the invention is to provide such a scaffold structure that can be disassembled and placed into a substantially flat configuration for easy storage.

Another object of the invention is to provide a scaffold structure wherein the components thereof can be simply and easily locked together to provide a secure platform of selected height and width.

Still another object of the invention is to provide such a scaffold structure wherein the components thereof can be secured together when stored to provide a unitary structure of substantially flat configuration.

BRIEF DESCRIPTION OF THE DRAWINGS

The abovementioned and other features and objects of this invention and the manner of attaining them will become more apparent and the invention itself will be best understood by reference to the following description of an embodiment of the invention taken in conjunction with the accompanying drawings wherein.

DESCRIPTION OF A SPECIFIC EMBODIMENT

Figure 1:
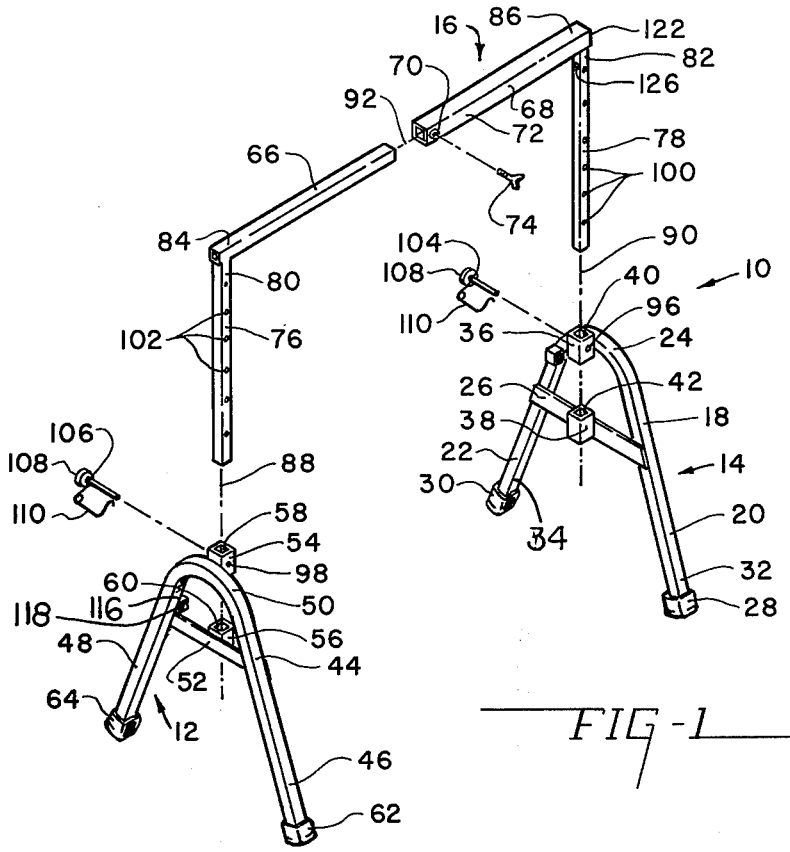
FIG. 1 is an exploded, perspective view of a scaffold structure in accordance with the present invention.

Referring now to the drawings, there is shown a scaffold structure 10 comprising leg frames 12, 14 and a support frame 16. Leg frame 14 inludes an elongated member 18, made of a suitable rigid, tubular material such as steel or aluminum and having a hollow, rectangular cross-section and being formed into a generally arch-shaped configuration as by bending. Thus formed, member 18 includes a pair of spaced-apart legs 20, 22 joined by a top portion 24.

A rigid brace 26 is fixedly secured as by welding to the leg portions 20, 22 in spaced-apart relationship to top portion 24. Preferably, suitable skid-resistant caps 28, 30 are frictionally secured to the distal ends 32, 34, respectively, of leg portions 20, 22.

Upper and lower collar elements 36, 38, respectively, made from a suitable tubular material of rectangular cross-section are fixedly secured to top portion 24 and brace 26, respectively, in positions such that the openings 40, 42, respectively, thereof are disposed in vertical registry.

Leg frame 12 is similarly constructed including an arched member 44 having leg portions 46, 48 joined by a top portion 50. A brace 52 extends between leg portions 46, 48 with upper and lower collar elements 54, 56 being secured to portion 50 and brace 52 as by welding with their openings 58, 60, respectively, being disposed in vertical registry. Anti-skid pads 62, 64 are frictionally secured to the lower ends of leg portions 46, 48, respectively.

Platform frame 16 includes a pair of telescopically engaged platform support members 66, 68. In a working embodiment of the invention, members 66, 68 are fabricated from a rigid, tubular material of rectangular cross-section with members 66 and 68 having outside and inside dimensions, respectively, such that member 66 is slidably received within member 68. Both members 66 and 68 are elongated such that they may be relatively extended or contracted to a desired length without significant reduction in the rigidty thereof. Member 68 is provided with a threaded element 70 such as a conventional nut, element 70 being fixedly secured to the sidewall 72 of member 68 as by welding. Sidewall 72 further has a hole (not shown) therethrough disposed in registry with the threaded opening of element 70. A threaded fastener 74 such as a wing nut bolt is threadingly received in element 70 whereby, when member 66 is received within member 68, fastener 74 can be manually tightened to thereby lock member 66 to member 68.

Platform frame 16 further includes a pair of posts 76, 78. Posts 76, 78 are elongated and are secured at ends 80, 82, thereof respectively, to the distal ends 84, 86 of members 66, 68, posts 76, 78 being disposed in position with their axes 88, 90, (FIG. 1 only) respectively, extending perpendicular to the axis 92 of members 66, 68. Posts 76, 78 are again of rectangular cross-section and have outside dimensions such that they are slidably received within the openings 40, 42 and openings 58, 60 of collar elements 36, 38 and 54, 56, respectively. It will be observed that, because of the rectangular cross-section of the openings 40, 42 and 58, 60, and the rectangular cross-section of the posts 76, 78, the leg frames 12, 14 will be positively retained with their leg portions 20, 22 and 46, respectively in planes generally perpendicular to the plane of platform frame 16, the rectangular cross-sections restraining the leg frames 12, 14 against relative rotational movement with respect to the platform frame 16.

Upper collar elements 40 and 54 are each provided with axially aligned holes as at 96, 98 extending through oppositely disposed walls thereof. Posts 76, 78 are further provided with holes as at 100, 102 formed therethrough. Holes 100, 102 and holes 96, 98 are positioned such that respective pairs of the holes 100, 102 will be in registry with corresponding ones of the holes 96, 98 at different selected and vertically displaced positions of the platform frame 16.

Locking pins 104, 106 are provided for securing the platform frame 16 in its selected vertically displaced positions. Pins 104, 106 are provided with enlarged heads as at 108, have a length dimension greater than the outside dimensions of the collar elements 36, 38, and have a diameter such that they are slidably received through the holes 96, 98 and corresponding holes 100, 102 of platform frame 16. Preferably, pins 104, 106 are also provided with spring clips as at 110. Clips 110 are resilient and formed into a generally U-shaped configuration such that, when the pins 104, 106 are inserted through the collar elements 36, 38, the clips 110 will lockingly engage the collar elements 36, 38 and thereby positively retain the pins 104, 106 in their inserted positions. To remove the pins it is only necessary to manually deform the clips 110 sufficiently to disengage them from the collar elements 36, 38 and slide the pins outwardly from the holes 96, 98.

Figure 2:
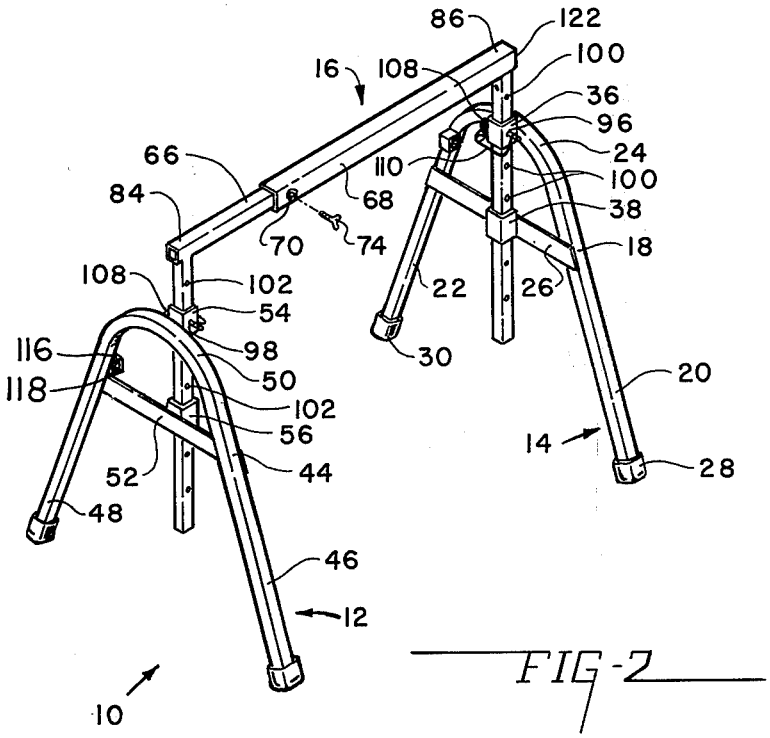
FIG. 2 is a perspective view of the scaffold structure of the present invention assembled for use with the platform support disposed above the top portion of the leg frames.
Figure 3:
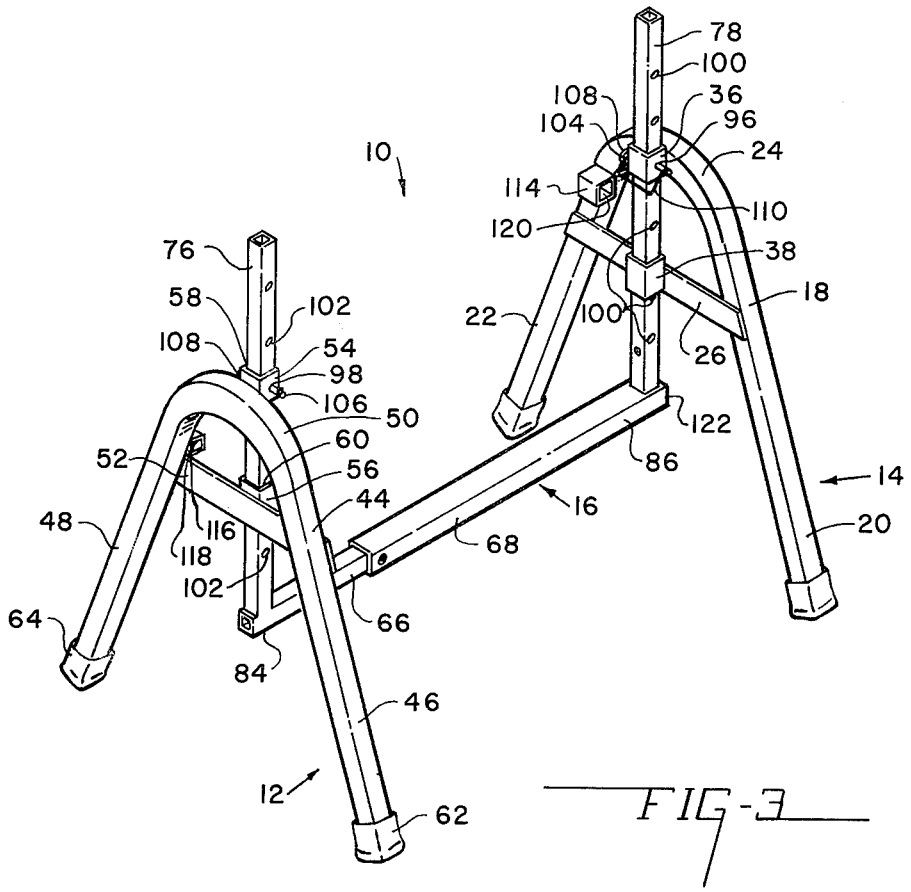
FIG. 3 is a perspective view of the scaffold structure of the present invention with the platform support disposed below the top portions of the leg frames.

In FIG. 2, the scaffold structure 10 is shown assembled with the posts 76, 78 inserted vertically downwardly through the collar elements 40, 42 and 54, 56. Thus assembled, the platform frame has its members 66, 68 disposed above top portions 24 and 50 of the leg frames 12 and 14. In the alternative, posts 76, 78 can be inserted vertically upwardly through the collar elements 36, 38 and 54, 56 as shown in FIG. 3. Thus assembled, members 66, 68 are disposed below top portions 24 and 50. It will further be observed that the platform frame can be secured in a multiplicity of selected vertically spaced-apart positions ranging from a position closely adjacent to the supporting floor to a substantially elevated position.

Figure 4:
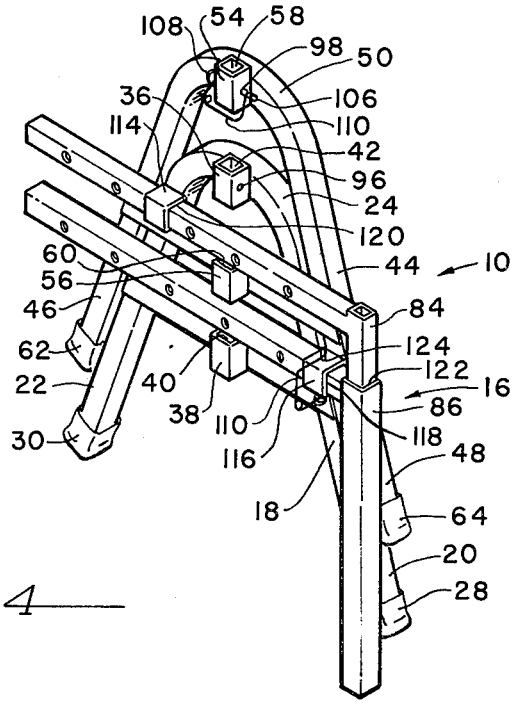
FIG. 4 is a perspective view of the scaffold structure of the present invention in its storage configuration.

Referring now particularly to FIG. 4, the scaffold structure 10 is shown disassembled and secured for storage. To further enhance the storability of the structure 10, leg frames 12, 14, may each be provided with a storage collar 114, 116, respectively. Collars 114, 116 are substantially identical to collar elements 36, 38 and 54, 56 except that collars 114, 116 are fixedly secured to the leg frames 12, 14 with their openings disposed horizontally (as viewed in the drawings) the openings 118, 120 thereof being dimensioned to slidably receive therein the posts 76, 78. To store the scaffold structure 10, the platform frame 16 is removed from the leg frames 12, 14 by removing pins 104, 106. The leg frames 12, 14 are then stacked as shown in FIG. 4. Platform frame 16 is secured to the leg frames 12, 14 by removing member 66 from member 68 and reinserting member 66 into member 68 from the opposite end 122 thereof. Posts 76, 78 are then slidably inserted through the collar elements 114, 116. Preferably, collar element 114 is provided with holes 124 therethrough dimensioned to receive one of the retaining pins 104, 106. Further, one of the posts 76, 78 is provided with holes therethrough as at 126 whereby the retaining pin 106 passes through the collar 114 and post 76 to positively secure the support platform 16 to the leg frames 12 and 14. Thus secured, it will be seen that the elements 12, 14 and 16 are all positively locked together such that they cannot be separated. It will further be observed that the platform structure thus assembled for storage is a relatively flat package that can be easily carried in an automobile trunk, hung on a wall, or the like.

From the above description, it will be seen that the scaffold structure of the present invention provides a uniquely suitable structure for supporting a work platform or a work piece. The scaffold structure is rugged, simple in construction, and can be adjusted both for the height of the work platform and the width thereof. The scaffold structure 10 includes locking means that positively prevents accidental separation of relative movement between the components thereof. The structure 10 is light in weight, and can be disassembled and reassembled in a storage configuration wherein the structure 10 is exceptionally compact and, because all of the components thereof are secured together, loss thereof is obviated. The support platform 16 can be inserted into the leg frames 12, 14 either with the platform members 66, 68 disposed above or below the top portions 24, 50 of the leg frames 12, 14 as desired whereby, when the structure is used to support a work platform, the platform can be situated at a height for optimum utilization.

While there have been described above the principles of this invention in connection with specific apparatus, it is to be clearly understood that this description is made only by way of example and not as a limitation to the scope of the invention.

What is claimed is:

1. A scaffold structure comprising at least two rigid leg frames, each set of leg frames including a pair of spaced-apart legs and a top portion, upper collar elements each having an opening therethrough and being secured to said top portion with said openings extending vertically, a platform frame including a pair of parallel spaced-apart post members having cross-sections complementary to said collar openings whereby said posts are slidably, vertically received through said upper collars, respectively, a platform support including a pair of telescopically engaged platform members fixedly secured adjacent their distal ends to respective ones of the upper ends of said post members, post locking means for locking said posts in selected vertically displaced positions to said collar members with said platform members extending laterally between said leg frames in a plane generally perpendicular to the plane including said legs, support locking means for locking said support members in selected telescopically extended positions, a storage collar element fixedly secured to each of said leg frames, each said storage collar element having an opening therethrough, said openings having an axis disposed generally parallel to a plane including said legs, said storage collar openings being dimensioned to slidably receive said posts therethrough, the outer one of said platform members being open at both ends thereof, the inner one of said platform members being slidably receivable into either end thereof, whereby said leg frames can be vertically stacked in interlocking relationship upon one another, said platform support can be assembled with said posts in closely spaced-apart relationship with said posts being slidably received in said storage collar elements.

2. The structure of claim 1 wherein said support locking means includes a threaded opening through the outer one of said telescopically engaged platform members and a threaded element threadingly received therein, said threaded element frictionally engaging the inner one of said telescopically engaged platform members upon rotation thereof to thereby lock said members.

3. The structure of claim 1 wherein at least one of said storage collar elements includes locking means for locking one of said posts thereto.

4. The structure of claim 1 further including a brace fixedly secured between said leg portions of each said leg frame in vertically spaced-apart relationship to said top portion, a lower collar element having an opening therethrough secured to each of said braces with the opening thereof in axial alignment with the respective one of said openings of said upper collar elements, said lower collar element openings being dimensioned to receive said posts therein.

5. The structure of claim 4 wherein said upper and lower collar elements are tubular elements of rectangular cross-section, said posts having a rectangular cross-section dimension to be slidably received within said upper and lower collar elements, relative rotational movement therebetween being restrained thereby.

6. The structure of claim 4 wherein said post locking means includes a pair of holes formed in axial registry through opposite sides of one of said upper and lower collar members, a plurality of vertically spaced-apart holes through said posts in positions in registry with said collar holes at each vertically spaced-apart position of said platform frame, and a retaining pin having a length greater than the distance between said collar holes and a diameter dimensioned to be slidably received therein.

7. The structure of claim 6 wherein said retaining pins further include a spring clip having a U-shaped configuration and dimensioned to resiliently and lockingly engage said collar elements when said retaining pins are received therein.

8. The structure of claim 4 wherein said leg frames are formed of a single elongated member formed into an arch, said leg portions being the distal ends of said member, said top portion being the apex portion of said arch.

9. The structure of claim 8 wherein said posts are received through said upper and lower collar elements with said platform members disposed in a position above said top portions.

10. The structure of claim 8 wherein said posts are received through said upper and lower collar elements with said platform members disposed below said top portions.

* * * * *